US007808460B2

(12) United States Patent
Nakajima

(10) Patent No.: US 7,808,460 B2
(45) Date of Patent: Oct. 5, 2010

(54) DISPLAY LED DRIVE CIRCUIT

(75) Inventor: Chiaki Nakajima, Minato-ku (JP)

(73) Assignee: Komaden Corporation, Tokyo (JP)

( * ) Notice: Subject to any disclaimer, the term of this patent is extended or adjusted under 35 U.S.C. 154(b) by 891 days.

(21) Appl. No.: 10/552,990

(22) PCT Filed: Feb. 26, 2004

(86) PCT No.: PCT/JP2004/002288

§ 371 (c)(1),
(2), (4) Date: Oct. 13, 2005

(87) PCT Pub. No.: WO2004/093040

PCT Pub. Date: Oct. 28, 2004

(65) Prior Publication Data

US 2006/0197722 A1 Sep. 7, 2006

(30) Foreign Application Priority Data

Apr. 16, 2003 (JP) ..... 2003-111535

(51) Int. Cl.
*G09G 3/32* (2006.01)

(52) U.S. Cl. ..... 345/82; 345/83; 345/84

(58) Field of Classification Search ..... 345/35, 345/39, 77, 82–83; 315/169.3
See application file for complete search history.

(56) References Cited

U.S. PATENT DOCUMENTS 4,017,847 A * 4/1977 Burford et al. ..... 345/46
4,198,629 A * 4/1980 Marion ..... 345/46
4,355,308 A * 10/1982 Blossfeldt ..... 345/82
5,313,141 A * 5/1994 Kimball ..... 315/169.3
6,320,322 B1 * 11/2001 Tanaka ..... 315/169.3
2004/0046673 A1 * 3/2004 Kovarik et al. ..... 340/636.1

FOREIGN PATENT DOCUMENTS

| | | |
|---|---|---|
| EP | 0 967 590 | 12/1999 |
| JP | 60-131093 | 9/1985 |
| JP | 63-254490 | 10/1988 |
| JP | 5-67810 | 3/1993 |
| JP | 6-59886 | 8/1994 |
| JP | 11-191494 | 7/1999 |
| JP | 11-288252 | 10/1999 |
| JP | 2001-514432 | 9/2001 |
| JP | 2002-244619 | 8/2002 |

* cited by examiner

*Primary Examiner*—Alexander Eisen
*Assistant Examiner*—Stuart McCommas
(74) *Attorney, Agent, or Firm*—Edwards Angell Palmer & Dodge LLP

(57) ABSTRACT

A display LED drive circuit configured in such a manner that, for example, a constant current circuit, a green display LED circuit, and a red display LED circuit are connected in series and a resistor circuit having a resistor that generates a potential difference identical to the respective display LEDs is connected in parallel to the respective LED circuits. A corresponding switching element of the display LED circuit and a corresponding switching element of the resistor circuit connected in parallel are controlled to be opened and closed in opposite ways, another route connected to a source circuit in parallel is connected to the constant current circuit, a blue display LED circuit connected in parallel to the resistor circuit as described above, and a constant voltage diode in series, and a predetermined voltage is derived from an output terminal by the constant voltage diode and supplied to a control circuit.

2 Claims, 3 Drawing Sheets

DISPLAY LED DRIVE CIRCUIT

BACKGROUND OF THE INVENTION

1. Field of the Invention

The present invention relates to a display LED drive circuit for red color (R), green color(G), and blue color(B) used in an LED unit or the like disposed in large numbers in an LED display device for displaying a video picture, for example, on a large-sized screen.

2. Description of the Related Art

Hitherto, an LED display device having a large number of LED units disposed therein for displaying a video picture on a large-sized screen is known. A display LED drive circuit of the LED unit has a structure, for example, as shown in FIG. 3. The drive circuit shown in FIG. 3 has a red display LED 1*r*, a green display LED 1*g*, and a blue display LED 1*b* connected in parallel for a source circuit 4, and the display LEDs 1*r*, lg, lb are connected respectively to a constant current circuit 2 or a current limit circuit, which limits an electric current to a constant quantity and to a switching element 3 in series, and then respective switching elements 3*r*, 3*g*, 3*b* corresponding to the respective display LEDs 1*r*, 1*g*, 1*b* are grounded, so that control signals are fed from control signal input terminals 5*r*, 5*g*, 5*b* to the respective switching elements 3*r*, 3*g*, 3*b* to control opening and closing the same, thereby controlling turning ON and OFF of the display LEDs 1*r*, lg, lb as a load.

Patent Documents 1 to 3 disclose technologies relating to a display LED drive circuit used in a LED display device or the like. Patent Document 1 (JP-T-2001-514432) discloses a structure in which a DC power source is connected to a set of red, green and blue LEDs, and a value of resistance for programming a maximum current which passes through the respective LED set is set, whereby the maximum current passing through the respective LED set is maintained at a constant value in FIG. 1 and so on.

Patent Document 2 (JP-A-2002-244619) discloses a drive circuit including a common driver connected to red, green, and blue LEDs, first switching means for switching supply of voltage from a source circuit in sequence to LEDs of the respective luminescent colors, and second switching means for switching supply of display data for the respective luminescent colors in sequence to the driver synchronously with a switching operation of the first switching means, or a drive circuit including adjusting means for adjusting the voltage to be supplied to the LEDs of the respective luminescent colors according to the voltage drop characteristics of the LEDs for the respective luminescent colors, in FIG. 1 and FIG. 3, and so on.

Patent Document 3 (JP-A-11-191494) discloses a drive control circuit mounted to a band-shaped base member on which a plurality of LED lamp groups are arranged at low density at regular intervals for controlling the light emission of the respective LED lamp groups independently, wherein a shift register that receives input synchronously with a shift clock and stores preset light-emission control data, a latch circuit for reading and storing the light-emission control data according to latch signals, and a drive circuit for illuminating the LED according to the light-emission control data in the latch circuit according to enable signals are integrated therein in FIG. 3 and so on.

SUMMARY OF THE INVENTION

For example, in the display LED drive circuit in FIG. 3 described above, the constant current circuits 2 are provided, respectively, for the red display LED 1*r*, the green display LED 1*g*, and the blue display LED 1*b*. However, because the constant current circuit 2 generates a large amount of heat, provision of a number of constant current circuits 2 may cause such a problem that the temperature of the entire drive circuit increases, and hence breakage or shortening of service life of the display LEDs may result.

On the other hand, in the case of the drive circuit in which the switching means and the common constant current circuits for the red, green, and blue display LEDs are employed, disclosed in Patent Document 2, the number of the constant current circuits may be reduced to prevent the temperature increase of the circuit in association with the increase in the number of the constant current circuits. However, because it is necessary to provide the switching means for switching the voltage from the source circuit in sequence to the LEDs of the respective luminescent colors or the switching means for supplying display data to the driver synchronously with the switching operation, there may arise another problem such that the structure therefor is complicated and the cost increases.

Furthermore, although reduction of current consumption and lowering of the running cost are desired for the display LED drive circuit, the technology disclosed in Patent Document 2 cannot achieve simultaneous illumination of the red, green, and blue LEDS. Therefore, in order to obtain the same brightness as a full-time illuminatable structure, when switching illumination of the red, green, and blue LEDs by ⅓ hours period each, it is necessary to flow three times current to obtain three times brightness, and hence a large amount of current consumption is necessary.

In view of such circumstances, it is an object of the invention to provide a display LED drive circuit in which the number of constant current circuits is reduced, increase in temperature of the drive circuit is restrained to achieve prevention of breakage and increase in service life of an LED, and reduction of current consumption and reduction of manufacturing cost or running cost are achieved while securing required brightness. It is another object to provide a display LED drive circuit in which power source usage efficiency can be improved.

A display LED drive circuit according to the invention includes: a route for serially connecting a constant current circuit, a first display LED circuit in which a corresponding switching element is serially connected to a first display LED, and a second display LED circuit in which a corresponding switching element is serially connected to a second display LED; a first resistor circuit, in which a corresponding switching element is serially connected to a first resistor that generates the same potential difference as the potential difference generated by the first display LED, connected to the first display LED circuit in parallel; and a second resistor circuit, in which a corresponding switching element is serially connected to a second resistor that generates the same potential difference as the potential difference generated by the second display LED, connected in parallel with the second display LED circuit, and is characterized in that the corresponding switching element for the display LED circuit and the corresponding switching element of the resistor circuit connected to the display LED circuit in parallel are controlled to be opened and closed in opposite ways. In this arrangement, a desired voltage can be applied to the respective display LEDs, and the number of constant current circuits can be reduced, and hence reduction of power consumption and the cost is achieved.

In addition, the display LED drive circuit of the invention is characterized in that the second resistor circuit includes a cut-off switching element serially connected to the second resistor and the corresponding switching element, and opens and closes the cut-off switching element synchronously with the corresponding switching element of the first display LED circuit disposed on an upstream side. In this arrangement, flowing electric current can easily be cut off when both of the display LEDs connected serially are in OFF state, and reduction of current consumption is achieved.

A display LED drive circuit of the invention includes: a route for serially connecting a constant current circuit, a display LED circuit in which a corresponding switching element is serially connected to a display LED, and a constant voltage diode; and a resistor circuit, in which a corresponding switching element is serially connected to a resistor that generates the same potential difference as the potential difference generated by the display LED, connected to the display LED in parallel, and is characterized in that the corresponding switching element of the display LED circuit and the corresponding switching element of the resistor circuit are controlled to be opened and closed in opposite ways, and in that an output terminal for deriving voltage is provided between the display LED circuit and the constant voltage diode. In this arrangement, improvement of the power source usage efficiency is achieved.

A display LED drive circuit according to the invention includes: a first current route and a second current route which are connected to a power circuit in parallel, the first route including: a first constant current circuit; a first display LED circuit in which a corresponding switching element is serially connected to a first display LED; and a second display LED circuit in which a corresponding switching element is serially connected to a second display LED, connected in series; a first resistor circuit, in which a corresponding switching element is serially connected to a first resistor that generates the same potential difference as the potential difference generated by the first display LED, connected to the first display LED circuit in parallel, and a second resistor circuit, in which a cut-off switching element and a corresponding switching element are serially connected to a second resistor that generates the same potential difference as the potential difference generated by the second display LED, connected to the second display LED circuit in parallel; the second route including: a second constant current circuit; a third display LED circuit in which a corresponding switching element is serially connected to a third display LED; and a constant voltage diode; a third resistor circuit, in which a corresponding switching element is serially connected to a third resistor that generates the same potential difference as the potential difference generated by the third display LED, connected to the third display LED in parallel; and is characterized in that the corresponding switching elements of the respective display LED circuits and the corresponding switching elements of the respective resistor circuits connected in parallel correspondingly with the respective display LED circuits are controlled to be opened and closed in opposite ways, in that the cut-off switching element is controlled to be opened and closed synchronously with the corresponding switching element of the first display LED circuit disposed on an upstream side, and in that an output terminal for deriving a voltage is provided between the third display LED circuit and the constant voltage diode.

In addition, the display LED drive circuit of the invention is characterized in that one of the first and the third display LEDs is a green display LED, and the other one is a blue display LED. In this arrangement, voltage drop can be averaged, and required power source voltage can be reduced to lighten a load to the drive circuit.

The display LED drive circuit of the invention can reduce the number of the constant current circuits or the current limit circuits and hence advantages such as restriction of increase in temperature of the drive circuit, prevention of breakage or elongation of service life of the LED, and reduction of the manufacturing cost and improvement of the power source usage efficiency are achieved. In addition, in the circuit structure in which the number of the constant current circuits is reduced, the current consumption of the entire circuit can be reduced while obtaining required brightness, and hence a running cost can be reduced and the power can be saved. By providing the constant voltage diode, improvement of the power source usage efficiency is achieved.

DETAILED DESCRIPTION OF EXEMPLARY EMBODIMENTS

Figure 1:
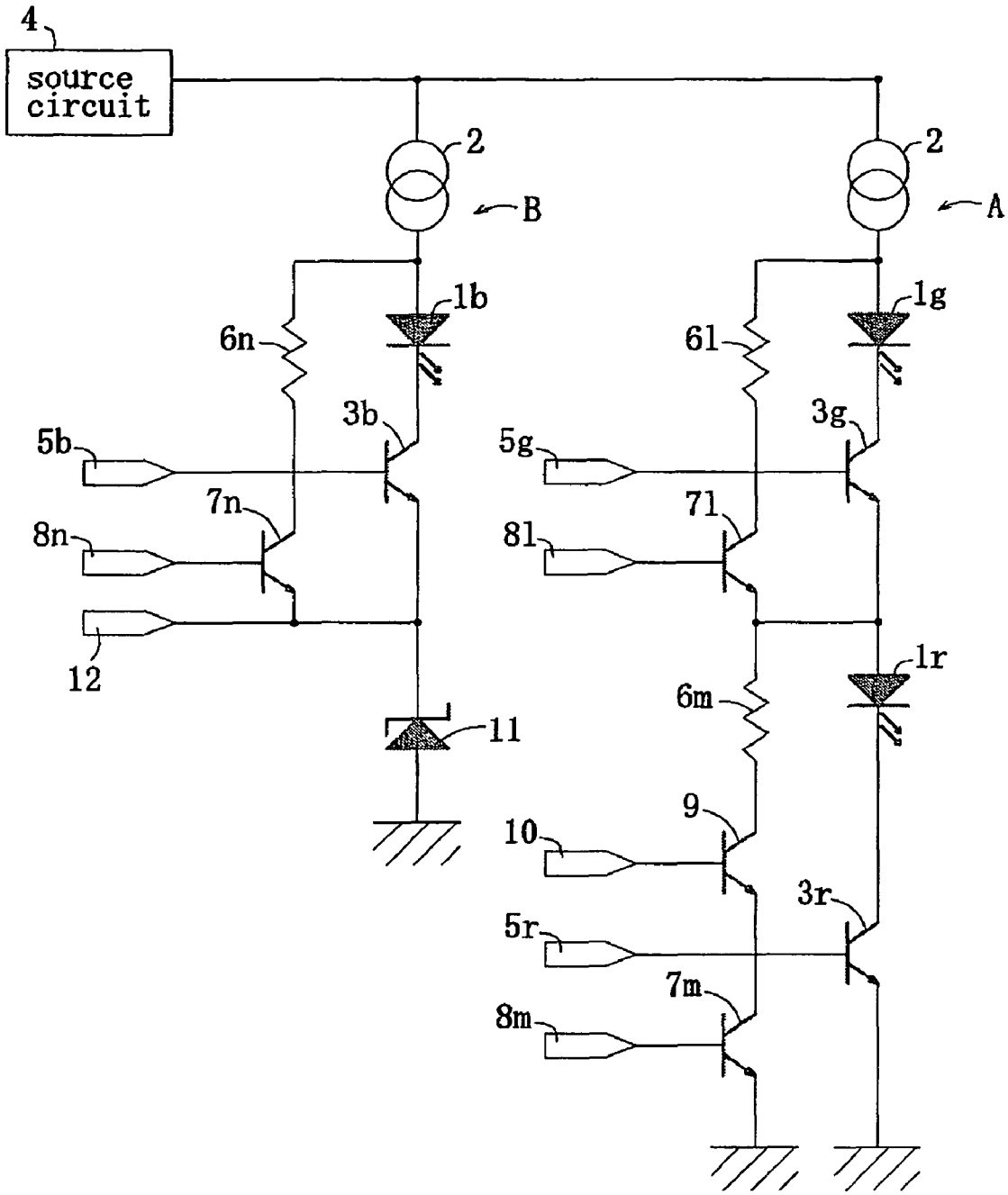
FIG. 1 is a drawing showing a structure of a display LED drive circuit according to a first embodiment.

Embodiments of a display LED drive circuit of the invention will be described below. FIG. 1 is a drawing showing a structure of a display LED drive circuit according to a first embodiment.

The display LED drive circuit according to the first embodiment is used, for example, for an LED unit of an LED display device that includes a number of LED units connected in series or the like and displays a video picture on a large-sized screen, an LED unit for decorative display such as illumination, or the like, and, as shown in FIG. 1, includes a first current route A and a second current route B, which are connected to a source circuit 4 in parallel, between the source circuit 4 of a DC power source and an earth potential.

The first current route A is provided with a constant current circuit 2 on an upstream side of a main route, that is, on the side of the source circuit, and a green display LED circuit having a switching element 3*g* corresponding to a green (G) display LED 1*g* and being connected serially for opening and closing the switching element 3*g* on the basis of control signals from a control signal input terminal 5*g* to drive the green display LED 1*g*, and a red display LED circuit having a switching element 3*r* corresponding to a red (R) display LED 1*r* connected serially for opening and closing the switching element 3*r* on the basis of control signals from a control signal input terminal 5*r* in sequence, on a downstream side (an earth potential side) of the constant current circuit 2 on the main route.

A switching element 7*l* corresponding to a first resistor 61 is serially connected, and a first resistor circuit for opening and closing the switching element 7*l* on the basis of control signals from a control signal input terminal 81 is installed in a state of being connected to the green display LED 1*g* and the corresponding switching element 3*g* or the green display LED circuit on the main route in parallel. A value of resistance of the first resistor 61 is set to a value which equalizes a potential difference generated between both ends of the display LED 1*g* when all the current to be controlled by the constant current circuit 2 of the first current route A is flowed to the display LED 1*g* (voltage in the normal direction) and a potential difference generated between both ends of the first resistor 61 when all the same current is flowed to the first resistor 61, and the potential difference is, for example, 3.5 V.

Further, a cut-off switching element 9 and, on the downstream side thereof, a switching element 7*m* are serially connected to a second resistor 6*m*, so that a second resistor circuit for opening and closing the cut-off switching element 9 on the basis of control signals from a control signal input terminal 10, and opening and closing the switching element 7*m* on the basis of control signals from a control signal input terminal 8*m* are connected to the red display LED 1*r* and the corresponding switching element 3*r* or the red display LED circuit on the main route in parallel. A value of resistance of the second resistor 6*m* is set to a value which equalizes a potential difference generated between both ends of the display LED 1*r* when all the current to be controlled by the constant current circuit 2 of the first current route A is flowed to the display LED 1*r* (voltage in the normal direction) and a potential difference generated between both ends of the second resistor 6*m* when all the same current is flowed to the second resistor 6*m*, and the potential difference is, for example, 2.0 V. The cut-off switching element 9 may be provided on the downstream side of the switching element 7*m*.

On the other hand, the second current route B is provided with the constant current circuit 2 on the upstream side of a main route, that is, on the side of the source circuit, and a blue display LED circuit having a switching element 3*b* corresponding to a blue (B) display LED 1*b* and being connected serially for opening and closing the switching element 3*b* on the basis of control signals from a control signal input terminal 5*b* to drive the blue display LED 1*b* is installed on the downstream side (earth potential side) of a constant current circuit 2 as a main circuit, and a constant voltage diode 11 having a cathode on the side of the source circuit 4 and an anode on the side of the ground potential on the downstream side (ground potential side) of the blue display LED 1*b* and the corresponding switching element 3*b* or the blue display LED circuit.

A switching element 7*n* corresponding to a third resistor 6*n* is serially connected, and a third resistor circuit for opening and closing the switching element 7*n* on the basis of control signals from the control signal input terminal 8*n* is connected to the blue display LED 1*b* and the corresponding switching element 3*b* or the blue display LED circuit on the main route in parallel. A value of resistance of the third resistor 6*n* is set to a value which equalizes a potential difference generated between both ends of the display LED 1*b* when all the current to be controlled by the constant current circuit 2 on the second current route B is flowed to the display LED 1*b* (voltage in the normal direction) and a potential difference generated between both ends of the third resistor 6*n* when all the same current is flowed to the third resistor 6*n*, and the potential difference is, for example, 3.5 V.

Although one each of the display LEDs 1*g*, 1*r*, 1*b* are provided in the display LED circuit in the above-described example, it is also possible to connect the green display LED circuit having a plurality of display LEDs 1*g*, 1*r*, or 1*b* connected in series and the resistor circuit in parallel, and set a value of resistance of the respective resistors 6*l*, 6*m* or 6*n* to a value which equalizes a potential difference generated between both ends of the display LEDs 1*g*, 1*r*, or 1*b* at both ends of the serial connection when all the current to be controlled by the constant current circuit 2 is flowed to the display LEDs 1*g*, 1*r*, or 1*b* connected in series (voltage in the normal direction) and a potential difference generated between both ends of the resistors 6*l*, 6*m*, or 6*n* when all the same current is flowed to the resistors 6*l*, 6*m*, or 6*n*. The potential difference in the above-described structure corresponds to a value obtained by multiplying the number of serial connections of display LEDs 1 by the potential difference at the respective display LEDs 1.

The respective switching elements 3, 7, 9 of the drive circuit are adapted to be opened and closed according to control signals or control voltage supplied from a control unit or a control circuit, not shown, to the respective control signal input terminals 5, 8, 10.

In the opening and closing control, the switching element 3 of the display LED circuit of the drive circuit opens and closes exclusively, or inversely to, the switching element 7 of the resistor circuit connected correspondingly in parallel with the display LED circuit according to control signals supplied from the control unit or the control circuit, not shown, to the control signal input terminals 5, 8. In other words, control is made by supplying the control signals or the control voltage so that there are always inverse relationships between the switching elements 3*g* and 7*l*, between the switching elements 3*r* and 7*m*, and between the switching elements 3*b* and 7*n* as regards the opening state and the closing state, respectively.

Furthermore, the cut-off switching element 9 of the second resistor circuit and the switching element 3*g* corresponding to the green display LED 1*g* on the upstream side are adapted to be opened and closed synchronously according to control signals supplied from the control unit or the control circuit, not shown, to the control signal input terminals 10, 5*g*, and hence the control signals or the control voltage are supplied so that they assume the same state as regards the opening state and the closing state.

There is provided an output terminal 12 between the blue display LED circuit or the third resistor circuit and the constant voltage diode 11, so that current controlled to a predetermined quantity in the constant current circuit 2 of the second current route B is derived from the output terminal 12, and the current derived from the output terminal 12 is supplied to the control unit or the control circuit that inputs control signals to the control signal input terminals 5, 8, 10 for carrying out the opening and closing control. Corresponding to the above-described structure, it is adapted that breakdown voltage of the constant voltage diode 11 is set to the same value as a power source voltage which is required or accepted by the control unit or the control circuit and a predetermined voltage such as 2.0 V is acquired by the constant voltage diode 11. Current consumption required by the control unit or the control circuit is set to a value which is the same as or smaller than a current of a predetermined amount controlled by the constant current circuit 2 of the second current route B.

Figure 3:
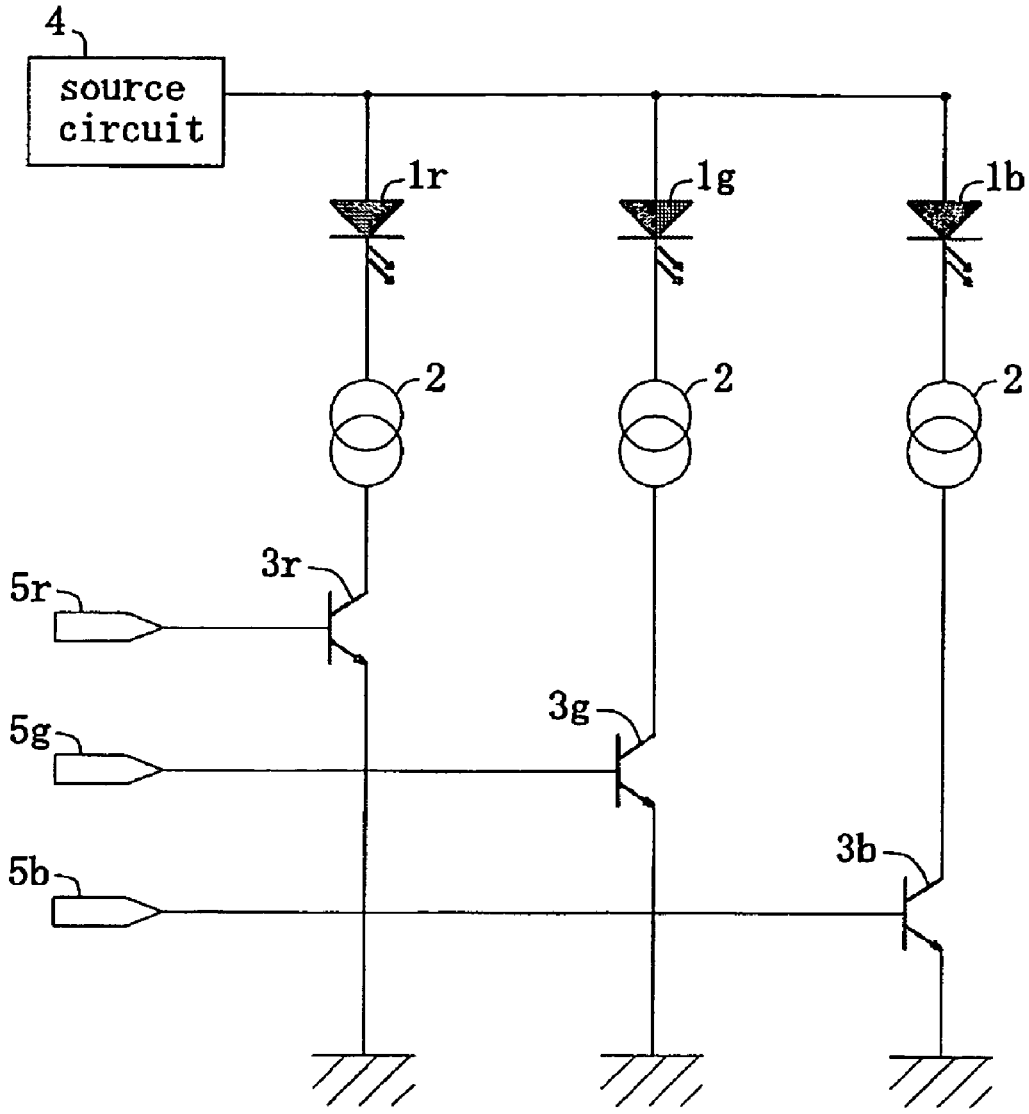
FIG. 3 is a drawing showing a structure of a display LED drive circuit in the related art.

In the drive circuit of the first embodiment, the number of the constant current circuits 2 can be reduced to ⅔ of that in the drive circuit in the related art shown in FIG. 3. Therefore, the temperature increase of the entire drive circuit may be restrained in association with the reduction of the number of the constant current circuits 2 generating a large amount of heat. In addition, because the constant current circuit 2 is expensive, the manufacturing cost can be reduced in association with the reduction of the number of the constant current circuits. The structure of the drive circuit in the first embodiment is slightly complicated in comparison with the structure of the drive circuit in FIG. 3, and hence the cost is increased correspondingly. However, the cost reduction effect described above can compensate sufficiently for the cost increase described above.

According to the display LED drive circuit in the first embodiment, because the display LED circuit and the corresponding resistor circuit having the resistor 6 which generates the same potential difference as the display LED 1 are connected in parallel, and the corresponding switching elements 3, 7 are controlled to be opened and closed exclusively or inversely to each other so that the resistor circuit serves as an electric current path when the display LED 1 is turned OFF, a desired voltage can be applied to the respective display LEDs 1 and the output terminal 12 can be brought into predetermined potentials when the display LED 1*b* is in the ON state and in the OFF state. Furthermore, by the provision of the constant voltage diode 11, the power source voltage to be supplied to the control unit or the control circuit can be derived stably from the output terminal 12, and hence installation of the source circuit for the control unit or the control circuit is not necessary. By the provision of the third resistor 6*n* corresponding to the display LED lb, the constant voltage diode 11 with small acceptable loss can be employed, whereby the power source voltage can be derived from the output terminal 12 stably and the cost reduction is achieved.

Furthermore, in the display LED drive circuit in the first embodiment, it is necessary to set the power source voltage of the source circuit 4 or the potential difference between the source circuit 4 and the earth to a value higher than that in the case of the drive circuit in the related art in FIG. 3. However, with the reduction of the number of the constant current circuit 2, the power source usage efficiency when all the display LEDs are turned ON can be increased, and moreover, the power source usage efficiency can further be improved by deriving the power source voltage from the output terminal 12.

When the switching elements 3*g*, 3*r* are brought into the opened state by inputting the control signals and both of the display LEDs 1*g*, 1*r* connected in series in the first current route A are brought into the OFF state, the cut-off switching element 9, which is controlled to be brought into the opened state or the closed state in conjunction with the switching element 3*g*, is brought into the opened state. Therefore, current flowing in the constant current circuit 2 in the first current route A can be cut off to only allow the current flowing in the constant current circuit 2 to flow, whereby reduction of current consumption can be achieved and hence the power can be saved.

In addition, the drive circuit in the related art shown in FIG. 3 requires the amount of current consumption including the amount of current required for illuminating three display LEDs and the amount of current consumption of the control unit or the control circuit for the entire circuit. In contrast, with the drive circuit according to the first embodiment, the amount of current consumption for the entire circuit including the amount of current consumption of the control unit or the control circuit can be reduced to the amount of current required for illuminating the two display LEDs. From this point as well, the reduction of the current consumption is achieved, and hence the power can be saved.

The display LED drive circuit according to the first embodiment has a structure in which the green display LED 1*g* and the red display LED 1*r* are serially connected from the upstream side (side of the source circuit 4) on the first current route A, and the blue display LED 1*b* is provided from the upstream side (side of the source circuit 4) on the second current route B. However, according to the invention, the two display LEDs to be provided in serial connection on the first current route A and the display LED to be provided on the second current route B may be selected from red, green, and blue as needed as long as the RGB display LEDs are provided.

However, by providing the red display LED 1*r*, which is smaller in voltage drop than the green or blue display LEDs 1*g*, 1*b*, on the downstream side (earth side) of the first current route A, providing the green display LED 1*g* or the blue display LED 1*b* on the upstream side (side of the source circuit 4) of the first current route A and providing the blue display LED 1*b* or the green display LED 1*g* on the second current route B, voltage drop can be averaged between the first current route A and the second current route B, and the required power source voltage can be advantageously reduced to lighten a load to the drive circuit.

The drive circuit according to the first embodiment has a structure in which the constant current circuits 2 are provided at the uppermost positions of the main routes of the first current route A and the second current route B. However, in the invention, the positions to provide the constant current circuits 2 are arbitrary, and a constant current circuit 2 of an outlet type or a constant current circuit 2 of an inlet type can be employed as needed. The position to provide the cut-off switching element 9 may be any position as long as current of the current route can be cut off when both of the serially connected display LEDs are in the OFF state. The constant current circuit according to the invention also includes a constant current circuit by one resistor in addition to the constant current circuit employing a positive element.

Figure 2:
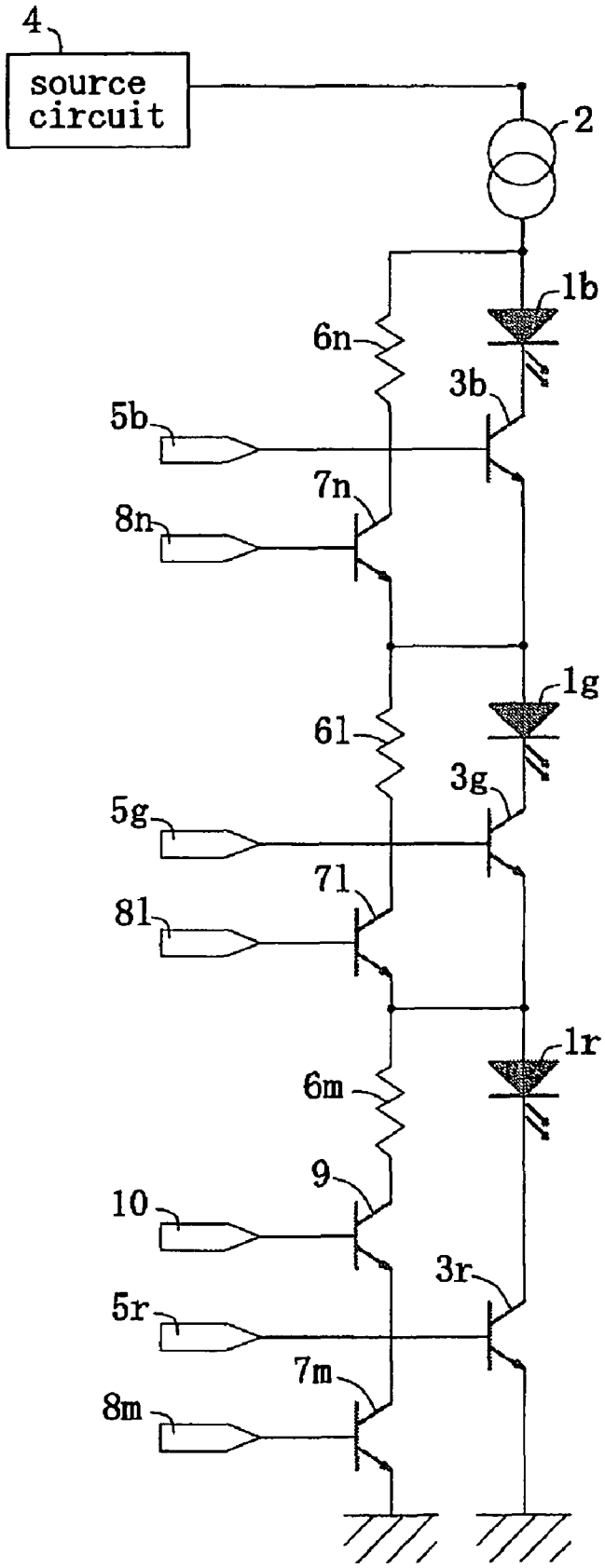
FIG. 2 is a drawing showing a structure of a display LED drive circuit according to a second embodiment.

The invention also includes a display LED drive circuit according to a second embodiment, for example, as shown in FIG. 2. The same reference numerals as in the first embodiment in FIG. 2 represent the same components.

A drive circuit shown in FIG. 2 includes display LED circuits in which the display LEDs 1*b*, 1*g*, 1*r* and the corresponding switching elements 3*b*, 3*g*, 3*r* are serially connected, all connected in series, and a resistor circuit in which the switching elements 8*n*, 81, 8*m* and the corresponding resistors 6*n*, 61, 6*m* are serially connected, respectively, is connected in parallel with respect to the respective display LED circuits. The resistor circuit connected to the red display LED circuit in parallel includes the cut-off switching element 9 as in the first embodiment . Control is made so that there are always inverse relationships between the switching elements 3*g* and 71, between the switching elements 3*r* and 7*m*, and between the switching elements 3*b* and 7*n* as regards the opening state and the closing state, and so that the cut-off switching element 9 and the switching element 3*g* corresponding to the green display LED 1*g* disposed on the immediately upstream side thereof are brought into the same state as regards the opening state and the closing state.

In the drive circuit according to the second embodiment, the number of the constant current circuits 2 can be reduced to ⅓ of that in the drive circuit in the related art shown in FIG. 3, and hence restriction of increase in temperature of the entire circuit or the cost reduction can be achieved, and the power source usage efficiency can be increased. Also, the switching elements 7 of the respective resistor circuits can be opened and closed exclusively or inversely to the switching elements 3 of the corresponding display LED circuits, so as to apply a desired voltage to the respective display LEDs 1. Also, by restraining the current consumption of the entire circuit to a value required for illuminating one display LED or for the control circuit, and additionally providing the cut-off switching element 9, the reduction of the current consumption is achieved and hence the power can be saved.

It is also possible to provide a structure in which the cut-off switching element 9 is omitted from the structures shown in FIG. 1 and FIG. 2, and the switching elements 3*r* and 7*m* are brought into the opened state simultaneously for turning OFF at required timings other than the inverse control of the switching elements 3, 7 as regards the opening state and the closing state, a structure in which control to bring the switching elements 3*g* and 7*l* into the opened state simultaneously for turning OFF is carried out in the structure shown in FIG.

2, or a structure in which control to bring the switching elements 3*b* and 7*n* into the opened state simultaneously for turning OFF at required timings is carried out, whereby electric current can be cut off to achieve reduction of the current consumption in the arrangement described above.

INDUSTRIAL APPLICABILITY

The display LED drive circuit according to the invention can be used, for example, for an LED unit or the like which is arranged in the LED display device for displaying a video picture on a large-sized screen by a large number.

The invention claimed is:

1. A display LED drive circuit comprising: a first current route and a second current route which are connected to a power circuit in parallel, the first route comprising: a first constant current circuit employing an active element; a first display LED circuit in which a corresponding switching element is serially connected to a first display LED; and a second display LED circuit in which a corresponding switching element is serially connected to a second display LED, connected in series;

a first resistor circuit, in which a corresponding switching element is serially connected to a first resistor that generates the same potential difference as the potential difference generated by the first display LED, connected to the first display LED circuit in parallel, and a second resistor circuit, in which a cut-off switching element and a corresponding switching element are serially connected to a second resistor that generates the same potential difference as the potential difference generated by the second display LED, connected to the second display LED circuit in parallel;

the second route comprising:

a second constant current circuit employing an active element;

a third display LED circuit in which a corresponding switching element is serially connected to a third display LED; and a constant voltage diode;

a third resistor circuit, in which a corresponding switching element is serially connected to a third resistor that generates the same potential difference as the potential difference generated by the third display LED, connected to the third display LED in parallel, wherein the corresponding switching elements of the respective display LED circuits and the corresponding switching elements of the respective resistor circuits connected in parallel correspondingly with the respective display LED circuits are controlled to be opened and closed in opposite ways, wherein the cut-off switching element is controlled to be opened and closed synchronously with the corresponding switching element of the first display LED circuit disposed on an upstream side, and wherein an output terminal for deriving a voltage is provided between the third display LED circuit and the constant voltage diode.

2. The display LED drive circuit according to claim 1, wherein one of the first and the third display LEDs is a green display LED, and the other one is a blue display LED.

* * * * *